United States Patent [19]

Black

[11] 4,382,340

[45] May 10, 1983

[54] STRAIGHT EDGE DEVICE

[76] Inventor: Kenneth C. Black, Site "E", R.R. #2, Nanaimo, British Columbia, Canada, V9R 5K2

[21] Appl. No.: 282,387

[22] Filed: Jul. 13, 1981

[51] Int. Cl.[3] ..... B43L 7/00

[52] U.S. Cl. ..... 33/413; 33/483

[58] Field of Search ..... 33/403, 413, 483, 161, 33/339, 342, 1 LE, 454, 414

[56] References Cited

U.S. PATENT DOCUMENTS

| | | | |
|---|---|---|---|
| 577,708 | 2/1979 | Barrie | 33/342 |
| 683,115 | 9/1901 | Gilliom | 33/413 |
| 1,544,153 | 6/1925 | Holmgren | 33/342 |
| 2,655,728 | 10/1953 | Cook | 33/414 |

FOREIGN PATENT DOCUMENTS

| | | | |
|---|---|---|---|
| 496700 | 4/1930 | Fed. Rep. of Germany | 33/414 |

*Primary Examiner*—Harry N. Haroian

*Attorney, Agent, or Firm*—Carver & Co.

[57] ABSTRACT

An apparatus forms a straight edge device when used with an elongate rigid member and a wire. The apparatus comprises a first member having a socket connectable to a first end of the elongate member, a reel for storing and tensioning the wire, and a first wire support for supporting the wire extending from the reel. The first member and the elongate member are entirely to one side of the wire extending from the first support towards a second end of the elongate member. A second member has a socket connectable to the second end of the elongate member. A free end of the wire distal the reel is securable to the second member. There is a second wire support on the second member for supporting the wire such that the second member and the elongate member are entirely to said one side of a straight length of the wire between the first and second wire supports. The length of wire forms a straight edge when the wire is tensioned by the reel.

10 Claims, 3 Drawing Figures

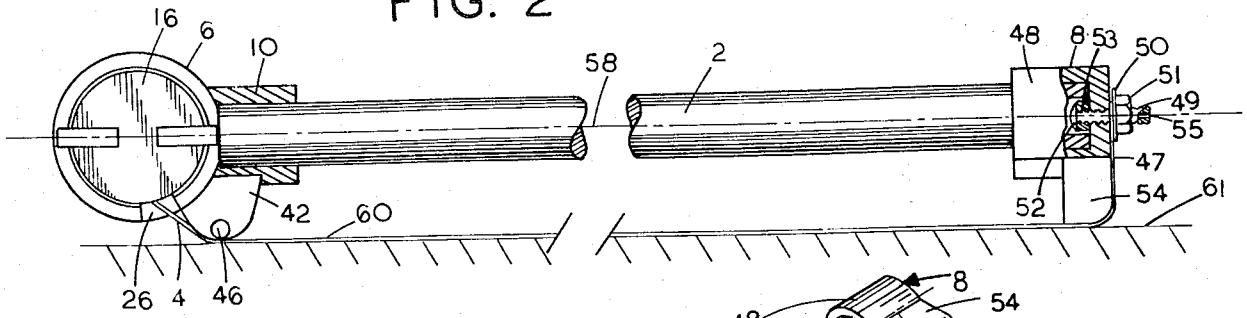
FIG. 2
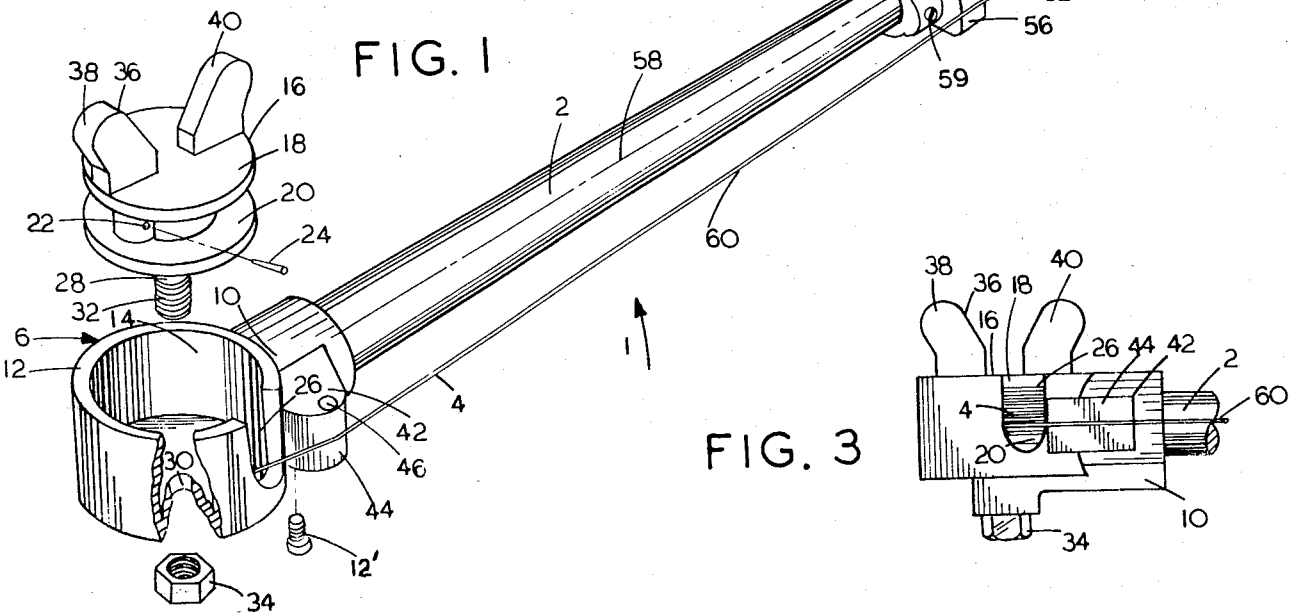
FIG. 1
FIG. 3

STRAIGHT EDGE DEVICE

BACKGROUND OF THE INVENTION

The invention relates to an apparatus for forming a straight edge device when used with an elongate rigid member, such as a pipe, and a wire.

Straight edges are frequently used by millwrights, carpenters, bricklayers, fitters and pipefitters. The main use for a straight edge is alignment, such as the alignment of pulleys, and testing the flatness of surfaces. The most common type of straight edge comprises at least one edge of a flat bar of metal. If the bar of metal becomes bent or otherwise damaged, as may occur on a construction site, the straight edge is rendered useless. A worker commonly finds it necessary to have straight edges of different lengths for different jobs. Some tasks require a short straight edge in places where a longer one would not fit. The short straight edge would be useless where a long one is required. Accordingly, it would be desirable to provide a straight edge device adaptable to different lengths and which would not be subject to easy damage by accidents.

A telescopic chalk line in disclosed in U.S. Pat. No. 2,655,728 to Cook. In this device, the chalk line is stretched between a reel at one end of a tubular rod and arm at the opposite end of the rod. The line plays out over a small pulley. The device is not, however, capable of replacing a standard straight edge. The chalk line is not sufficiently rigid and would be too susceptible to sagging or deflection unless perhaps placed over considerable tension. However, the coil spring provided for tensioning the line would be insufficient for this purpose. Additionally, it should be noted, as seen in FIG. 2 of this patent, that the opposite wall terminus of the casing wall projects beyond the chalk line. Accordingly, it is not possible to have the chalk line lie flatly on a longer surface as may be required of a straight edge.

Similar devices are found in U.S. Pat. Nos. 4,202,108 to Adams; 2,788,584 to Adrien; 4,141,146 to Broom; 4,084,321 to Huston; 683,115 to Gilliom; 577,708 to Barrie and 4,228,588 to Horton. However, none of these devices provides a satisfactory solution to the problem of providing a straight edge device having a variable length for construction sites or the like, and which would not be susceptible to easy damage.

SUMMARY OF THE INVENTION

The invention provides an apparatus for forming a straight edge device when used with an elongate rigid member and a wire. The apparatus comprises a first member having means connectable to a first end of the elongate member. The first member also has a reel for storing and tensioning the wire and a first wire support for supporting the wire extending from the reel such that the first member and the elongate member are entirely to one side of the wire extending from the first support towards a second end of the elongate member. A second member has means connectable to the second end of the elongate member, means for securing a free end of the wire distal the reel, and a second wire support for supporting the wire such that the second member and the elongate member are entirely to said one side of a straight length of the wire between the first and second wire supports. The length of wire forms a straight edge when the wire is tensioned by the reel.

Preferably, the first member further comprises a braking device for stopping rotation of the reel.

Unlike prior art devices, the apparatus according to the invention is capable of forming a straight edge device for replacing different lengths of straight edges used for carpentry work, bricklaying, aligning pulleys and the like. When properly tensioned, the wire is capable of forming a relatively rigid straight edge unlike the string or similar lines used in chalk line devices like those in U.S. Pat. No. 2,655,728 to Cook. Because the length of wire beween the first and second wire supports is entirely to one side of the apparatus, the straight edge formed by this length of wire may be laid flat against a surface to judge its flatness or straightness. This is not possible with the Cook device.

The apparatus can be adapted to be used with any convenient length of enlongate member, such as a pipe, easily available at construction sites. The length of the straight edge may be adjusted simply by replacing one length of pipe with one of a different length. The straight edge is completely straight providing the wire is properly tensioned regardless of whether or not the pipe is straight. Even if the assembled apparatus with the pipe is dropped so that the pipe is bent, the straight edge regains its usefulness once the wire is sufficiently tensioned on the reel. A telescopic device as found in the Cook patent would tend to collapse under significant tension of the line or wire, whereas the single elongate member of the present invention can withstand any reasonable forces without being shortened.

The use of a braking device for stopping rotation of the reel, as found in the present invention, is not suggested by the Cook patent where tension is maintained by a coil spring. This earlier approach offers disadvantages due to variable tension on the line depending upon the adjusted length of the telescopic member. The braking device allows the wire on an apparatus according to the invention to be maintained under considerable tension. The tension can be the same regardless of the length of the elongate member and the length of wire between the first and second wire supports.

BRIEF DESCRIPTION OF THE DRAWINGS

In the drawings:

FIG. 1 is an exploded, perspective view of an apparatus for forming a straight edge device with a wire and a length of pipe, one member thereof being partly broken away;

FIG. 2 is an elevational view of the apparatus of FIG. 1; and

FIG. 3 is a fragmentary bottom plan view of one end of the apparatus.

DESCRIPTION OF THE PREFERRED EMBODIMENT

The drawings illustrate an apparatus for forming a straight edge device 1 when used with an elongate, rigid member such as pipe 2 and with a wire 4. The apparatus includes a first member 6 and a second member 8. The first member 6 has a socket 10 providing means connectable to a first end of pipe 2 which is shown to the left in the drawings. The first end of the pipe is inserted into socket 10 and a set screw 12 extends through socket 10 to engage the first end of the pipe. The first member 6 is thereby rigidly connected to the first end of the pipe.

Socket 10 is part of body portion 12 of the first member which also has a cylindrical recess 14 for rotatably receiving a reel 16 of the first member. The reel member 16 has a pair of spaced-apart, disc-like members 18 and 20, between which wire 4 is coiled and thereby stored. An end of wire 4 adjacent the reel is inserted through aperture 22 of the reel and tightly held there by a tapered pin 24 which is thereinafter inserted. When the reel is properly inserted in cylindrical recess 14 of the body portion 12, wire 4 extends through the opening or slot 26 as shown.

The reel 16 has a shaft 28 rigidly connected thereto on a first side comprising the outside of disc-like member 20. The shaft is rotatably journalled in aperture 30 of the body portion and has a threaded portion 32 which extends therethrough.

The first member has a braking device comprising a nut 34 received on the threaded portion 32 of the shaft so the reel can be stopped by tightening the nut against the body portion 12. For convenience, a wing nut can be substituted for the hex nut which is illustrated.

Reel 16 has a handle 36 comprising two outward projections 38 and 40 on a second side thereof formed by the outside of disc-like portion 18 on the opposite side from shaft 28. Handle 36 permits the reel to be rotated to tension wire 4 when nut 34 is loosened.

First member 6 also has a first wire support 42 having a semi-cylindrical surface 44 for supporting the wire 4 extending from the reel towards a second end of pipe 2 as shown to the right of the drawings. The wire support is formed by a protrusion on the first member 6 extending from socket 10 adjacent the opening 26. A metal pin 46 is tightly received within an aperture in the first wire support 42 and forms a hard insert to reduce wear of the first member 6 by wire moving over the first support 42.

As may be appreciated from FIG. 2, the first wire support 42 supports the wire extending from the reel such that the first member 6 and the elongate member or pipe 2 are entirely to one side of the wire extending from the first support 42 towards the second end of the pipe shown to the right of the figure. This one side of the wire is towards the top of the wire from the point of view of FIG. 2.

The second member 8 has a cylindrical socket 48 connectable to the second end of the pipe 2 by means of a set screw 59. The wire has a free end 47 which is looped about an allen bolt 49 and tightened between a washer 50 and against member 8 by an outer nut 51 threadedly received on the allen bolt. A weld 52 connects the inner end of the allen bolt to an inner nut 53 within socket 48 and pipe 2. Nut 51 may be tightened with a spanner while an allen wrench is held within socket 55 to keep the allen bolt from rotating.

The second member 8 also has a second wire support 54, formed by a protrusion from socket 48, with a flat surface 56 for supporting the wire.

Pipe 2 has a longitudinal axis 58. As illustrated, the first member 6 and second member 8 are connected to the ends of pipe 2 such that the wire supports 42 and 54 are angularly aligned relative to axis 58 of the pipe. The straight length 60 of wire 4, formed when the wire is sufficiently tensioned by reel 16, is parallel to the axis. The wire supports 42 and 54 extend outwardly so that this length 60 of wire 4 is spaced-apart from pipe 2. Furthermore, both first member 6 and second member 8 are entirely to one side, that is above, the straight length of wire extending between the first and second supports. This straight length 60 of wire 4 thereby forms a straight edge when the wire is properly tensioned by the reel.

The user requires only first member 6 and second member 8 together with a required length of pipe 2 and a longer piece of wire 4 to form the straight edge device. Piano wire is suitable for use with the invention. A worker needs to carry only the first and second members in his toolbox with a length of wire coiled about the reel 16. When a straight edge is required, the worker merely chooses a pipe 2 approximately equal to the required length of the straight edge. Socket 10 is fitted over one end of the pipe and held tightly in place by tightening set screw 12. Socket 48 of the second member is then fitted over the opposite end of the pipe and the second wire support 54 is angularly aligned relative to the longitudinal axis of the pipe with the first wire support 42. Set screw 59 is then tightened to secure the second member on the pipe.

Reel 16 is normally located within cylindrical recess 14 of the first member with nut 34 on its threaded portion 32 as seen in FIGS. 2 and 3. The nut is loosened so that the free end 47 of the wire can be pulled outwardly through opening 26. The free end of the wire is secured to the second member by means of nut 51. With the wire supported by the two wire supports 42 and 54, handle 36 of the reel 16 is rotated to tension the wire to provide the tight and straight length 60 of wire between the two supports. When the wire is adequately tensioned, nut 34 is tightened against body portion 12 of the first member to maintain this tension. Pin 46 prevents undue wear of the first support 32 as the wire is pulled over the first support during the tensioning operation.

The length 60 of wire can then be used as a straight edge for many tasks in the conventional manner. This length of wire can be placed flatly against the longer surface 61, shown in FIG. 2, because the first and second members and the pipe are entirely to the one side of length 60 of the wire vertically above the surface 61.

Pipe 2 can be discarded if desired after the device is used so that the first and second members with the wire can be stored, for example, in a workman's toolbox and moved to another job site. Even if the pipe is somewhat bent prior to use or becomes bent due to damage after the straight edge device is assembled, the straight edge formed by length 60 of wire 4 remains true and accurate providing the wire is properly tensioned by reel 16.

What is claimed is:

1. An apparatus for forming a straight edge device when used with an elongate, rigid member and a wire, the apparatus comprising:

a first member having means connectable to a first end of the elongate member, a reel for storing and tensioning the wire and a first wire support for supporting the wire extending from the reel such that the first member and the elongate member are entirely to one side of the wire extending from the first support towards a second end of the elongate member;

a second member having means connectable to the second end of the elongate member, means for securing a free end of the wire distal the reel, and a second wire support for supporting the wire such that the second member and the elongate member are entirely to said one side of a straight length of the wire between the first and second wire supports, the length of wire forming a straight edge when the wire is tensioned by the reel; and the wire supports comprising protrusions on the first and second members, the wire supports being angularly aligned relative to a longitudinal axis of the elongate member when the first and second members are connected thereto so the length of wire is generally parallel to the axis, the wire supports extending outwardly so that the length of wire is spaced-apart from the elongate member, the first wire support having a hard insert to reduce wear of the first member by wire moving over the first support.

2. An apparatus as claimed in claim 1, wherein the hard insert is a metal pin.

3. An apparatus for forming a straight device when used with an elongate, rigid member and a wire, the apparatus comprising:

a first member having means connectable to a first end of the elongate member, a reel for storing and tensioning the wire, a first wire support for supporting the wire extending from the reel such that the first member and the elongate member are entirely to one side of the wire extending from the first support towards a second end of the elongate member, a braking device for stopping rotation of the reel, and a body portion having the means connectable to the elongate member and the first wire support, the reel having a shaft rigidly connected thereto, the shaft being rotatably journalled in the body portion and extending therethrough, the braking device comprising a nut received on a threaded portion of the shaft so the reel can be stopped by tightening the nut against the body portion; and a second member having means connectable to a second end of the elongate member, means for securing a free end of the wire distal the reel, and a second wire support for supporting the wire such that the second member and the elongate member are entirely to said one side of a straight length of the wire between the first and second wire supports, the length of wire forming a straight edge when the wire is tensioned by the reel.

4. An apparatus as claimed in claim 3, wherein the body portion has an opening for the wire extending from the reel, the first wire support being adjacent the opening.

5. An apparatus as claimed in claim 3, wherein the reel has the shaft on a first side thereof and a handle on a second side which is opposite the first side.

6. An apparatus for forming a straight edge device when used with an elongate, rigid member and a wire, the apparatus comprising:

a first member having a socket connectable to a first end of the elongate member, a reel for storing and tensioning the wire and a first wire support for supporting the wire extending from the reel such that the first member and the elongate member are entirely to one side of the wire extending from the first support towards a second end of the elongate member; and a second member having a socket connectable to a second end of the elongate member, means for securing a free end of the wire distal the reel, and a second wire support for supporting the wire such that the second member and the elongate member are entirely to said one side of a straight length of the wire between the first and second wire supports, the length of wire forming a straight edge when the wire is tensioned by the reel, the means for securing the free end of the wire comprising an allen bolt, an inner nut connected to the bolt within the socket of the second member, and an outer nut for tightening the wire looped about the allen bolt against the second member.

7. An apparatus for forming a straight edge device when used with an elongate, rigid member, the apparatus comprising:

a wire;

a first member having means connectable to a first end of the elongate member, a rotatable reel, a braking device for selectively stopping rotation of the reel, and a first wire support comprising a protrusion on the first member for supporting the wire adjacent the reel; and a second member having means connectable to a second end of the elongate member, securing means for securing a second end of the wire, and a second wire support comprising a protrusion on the second member for supporting the wire adjacent the securing means, the first and second wire supports being angularly aligned relative to a longitudinal axis of the elongate member when the first and second members are connected thereto so a length of wire supported between the first and the second wire supports and tensioned by the reel and the braking device forms a straight edge entirely to one side of the first member, the second member and the elongate rigid member.

8. An apparatus as claimed in claim 7, wherein the means connectable to the first end and the second end of the elongate member comprise sockets in the first member and the second member, respectively.

9. An apparatus as claimed in claim 8, wherein the elongate member is a pipe and the sockets are cylindrical.

10. An apparatus as claimed in claim 8, wherein the means connectable further comprises set screws extending through the sockets of the first member and the second member to engage the elongate member.

* * * * *